US006728985B2

(12) United States Patent
Brooke et al.

(10) Patent No.: US 6,728,985 B2
(45) Date of Patent: May 4, 2004

(54) AMBULATORY ASSIST ARM APPARATUS

(75) Inventors: Jason C. Brooke, Greensburg, IN (US); Roger D. Dalton, Moncks Corner, SC (US); Reza Hakamiun, Charleston, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 0 days.

(21) Appl. No.: 10/217,295

(22) Filed: Aug. 12, 2002

(65) Prior Publication Data

US 2003/0056293 A1 Mar. 27, 2003

Related U.S. Application Data

(60) Provisional application No. 60/312,408, filed on Aug. 15, 2001.

(51) Int. Cl.[7] ..... A61G 7/053

(52) U.S. Cl. ..... 5/662; 5/430; 5/600; 5/658

(58) Field of Search ..... 5/662, 658, 503.1, 5/430, 424, 428, 600

(56) References Cited

U.S. PATENT DOCUMENTS

| | | | |
|---|---|---|---|
| 421,656 | A | 2/1890 | Blanken |
| 2,585,660 | A | 2/1952 | Kjos et al. |
| 2,722,017 | A | 11/1955 | Burst et al. |
| 2,817,854 | A | 12/1957 | Pratt |
| 2,817,855 | A | 12/1957 | Pratt |
| 3,021,534 | A | 2/1962 | Hausted |
| 3,055,020 | A | 9/1962 | Mann |
| 3,249,387 | A | 5/1966 | Pivacek |
| 3,286,283 | A | 11/1966 | Bertoldo |
| 3,312,986 | A | 4/1967 | Fahrni et al. |
| 3,344,445 | A | 10/1967 | Crawford |
| 3,351,962 | A | 11/1967 | Dodrill et al. |
| 3,486,176 | A | 12/1969 | Murcott |

(List continued on next page.)

FOREIGN PATENT DOCUMENTS

| | | |
|---|---|---|
| WO | WO 82/02832 | 9/1982 |
| WO | WO 01/47340 | 7/2001 |

*Primary Examiner*—Michael F. Trettel
(74) *Attorney, Agent, or Firm*—Bose McKinney & Evans LLP

(57) ABSTRACT

An ambulatory assist arm apparatus for use with a patient support having a support surface and a frame includes a mounting bracket and a body. The mounting bracket is adapted for attachment to a first side of the frame when in a first position, and to a second side of the frame when in a second position. The body includes a first end defining a grip and a second end removably and pivotally connected to the mounting bracket by a pivot member for movement between a use position wherein the grip is positioned above the support surface when the mounting bracket is mounted in either the first or second positions, and a storage position wherein the grip is adjacent a first end of the frame when the mounting bracket is in either the first or second positions.

84 Claims, 8 Drawing Sheets

U.S. PATENT DOCUMENTS

| | | | | | |
|---|---|---|---|---|---|
| 3,585,659 | A | | 6/1971 | Burst et al. | |
| 3,865,434 | A | | 2/1975 | Sully | |
| 3,932,903 | A | | 1/1976 | Adams et al. | |
| 3,971,083 | A | | 7/1976 | Peterson | |
| 4,120,530 | A | | 10/1978 | Imbro | |
| 4,439,880 | A | | 4/1984 | Koncelik et al. | |
| 4,612,679 | A | | 9/1986 | Mitchell | |
| 4,680,790 | A | * | 7/1987 | Packard et al. | 379/432 |
| 4,747,171 | A | | 5/1988 | Einsele et al. | |
| 4,839,933 | A | | 6/1989 | Plewright et al. | |
| 4,932,090 | A | | 6/1990 | Johansson | |
| 4,993,089 | A | | 2/1991 | Solomon et al. | |
| 5,060,327 | A | | 10/1991 | Celestina et al. | |
| 5,083,430 | A | | 1/1992 | Hirata et al. | |
| 5,084,925 | A | | 2/1992 | Cook | |
| 5,195,200 | A | | 3/1993 | Leoutsakos | |
| D336,578 | S | | 6/1993 | Celestina | |
| 5,216,768 | A | | 6/1993 | Bodine et al. | |
| 5,231,721 | A | | 8/1993 | Fish | |
| 5,255,403 | A | | 10/1993 | Ortiz | |
| 5,335,385 | A | | 8/1994 | Brown | |
| 5,337,430 | A | | 8/1994 | Schlein | |
| 5,347,682 | A | | 9/1994 | Edgerton, Jr. | |
| 5,381,571 | A | | 1/1995 | Gabhart | |
| 5,384,927 | A | | 1/1995 | Mardero et al. | |
| 5,388,294 | A | | 2/1995 | Reeder | |
| 5,394,581 | A | | 3/1995 | Leoutsakos | |
| 5,418,988 | A | | 5/1995 | Iura | |
| 5,485,699 | A | | 1/1996 | Gabhart | |
| 5,542,136 | A | * | 8/1996 | Tappel | 5/710 |
| 5,542,138 | A | * | 8/1996 | Williams et al. | 5/658 |
| 5,586,352 | A | | 12/1996 | O'Brien et al. | |
| 5,678,267 | A | | 10/1997 | Kinder | |
| 5,689,839 | A | | 11/1997 | Laganière et al. | |
| 5,781,945 | A | | 7/1998 | Scherer et al. | |
| 5,787,530 | A | | 8/1998 | Brix | |
| 5,802,636 | A | | 9/1998 | Corbin et al. | |
| 5,806,111 | A | | 9/1998 | Heimbrock et al. | |
| 5,832,549 | A | | 11/1998 | Le Pallec et al. | |
| 5,836,026 | A | | 11/1998 | Reed | |
| 5,878,452 | A | | 3/1999 | Brooke et al. | |
| 6,058,531 | A | | 5/2000 | Carroll | |
| 6,185,767 | B1 | | 2/2001 | Brooke et al. | |
| 6,240,583 | B1 | | 6/2001 | Brooke et al. | |
| 6,397,416 | B2 | | 6/2002 | Brooke et al. | |

* cited by examiner

AMBULATORY ASSIST ARM APPARATUS

RELATED APPLICATIONS

This application claims the benefit of U.S. Provisional Patent Application Serial No. 60/312,408, filed Aug. 15, 2001, the disclosure of which is hereby expressly incorporated herein by reference.

FIELD OF THE INVENTION

The present invention relates generally to an ambulatory assist apparatus, and more specifically to an ambulatory assist arm apparatus for use with a patient support having a grip which is positioned above a patient support surface of the patient support when the ambulatory assist arm apparatus is in use.

BACKGROUND AND SUMMARY OF THE INVENTION

A goal of long-term healthcare facilities and hospitals is to improve the functional health, dignity, and independence of residents and patients. Many users of these facilities are elderly and physically frail. Accordingly, their strength, mobility, flexibility, and dexterity are often significantly impaired. These impairments, and the accompanying loss of independence, may result in daily frustration and even depression.

The ambulatory assist arm apparatus of the present invention assists such individuals during ingress onto and egress from a patient support surface such as a mattress of a hospital bed or long-term care facility bed. According to one embodiment of the invention, the assist arm includes a mounting bracket adapted for attachment to a first side of the bed frame when in a first position, and to a second side of the bed frame when in a second position, and a body having a first end defining a grip and a second end removably connected to the mounting bracket for movement relative to the mounting bracket. The body may be attached to the mounting bracket such that, regardless of the position of the mounting bracket, the body is movable between a use position wherein the grip is positioned above the support surface and a storage position wherein the grip is positioned adjacent one end of the patient support and substantially below the support surface. The mounting bracket includes pivot supports for movably supporting the body as it is pivoted between the use and the storage positions about a pivot member that extends through the second end of the body into one of the pivot supports. The mounting bracket further includes a plurality of stops which cooperate with a retainer attached to the body to lock or hold the arm in the use and storage positions. In one embodiment of the invention, the retainer includes a spring-biased detent which cooperates with the stops.

The body of the assist arm includes a frame that defines a central opening and provides a grip along an upper segment of the frame. A lower segment of the frame is connected to a curved extension that extends between the frame and the second end of the body such that the body frame is offset vertically and horizontally offset from the pivotal connection to the mounting bracket. The assist arm further includes a cradle disposed substantially within the central opening of the body frame. The cradle includes a first support disposed adjacent the grip, and a second support disposed adjacent the lower segment of the body frame. The first and second supports define openings for receiving a controller used to adjust the orientation of the bed. The second support includes a gap for accommodating a cord extending from the controller. Accordingly, the controller is removable from the cradle and accessible for use while positioned within the cradle.

According to another embodiment of the invention, the assist arm is connected to a bed having a frame with a head portion, a seat portion, and a foot portion. The bed further includes a side rail connected to the foot portion. The assist arm is connected to the head portion, is movable between a use and a storage position, and has a controller mounted thereon.

According to yet another embodiment of the invention, the bed includes a side rail connected to the foot portion, and a side rail connected to the head portion with a controller mounted thereon. The assist arm is connected to the seat portion, and is movable between a use and a storage position.

In yet another embodiment of the invention, the bed includes side rails connected to both the foot portion and the head portion, and an assist arm connected to the seat portion which includes a controller and is movable between a use and a storage position.

These and other features of the invention will become apparent to those skilled in the art upon consideration of the following detailed description of embodiments of the invention in conjunction with the accompanying drawings.

DESCRIPTION OF EMBODIMENTS OF THE INVENTION

The embodiments described below are merely exemplary and are not intended to limit the invention to the precise forms disclosed. Instead, the embodiments were selected for description to enable one of ordinary skill in the art to practice the invention.

Figure 1:
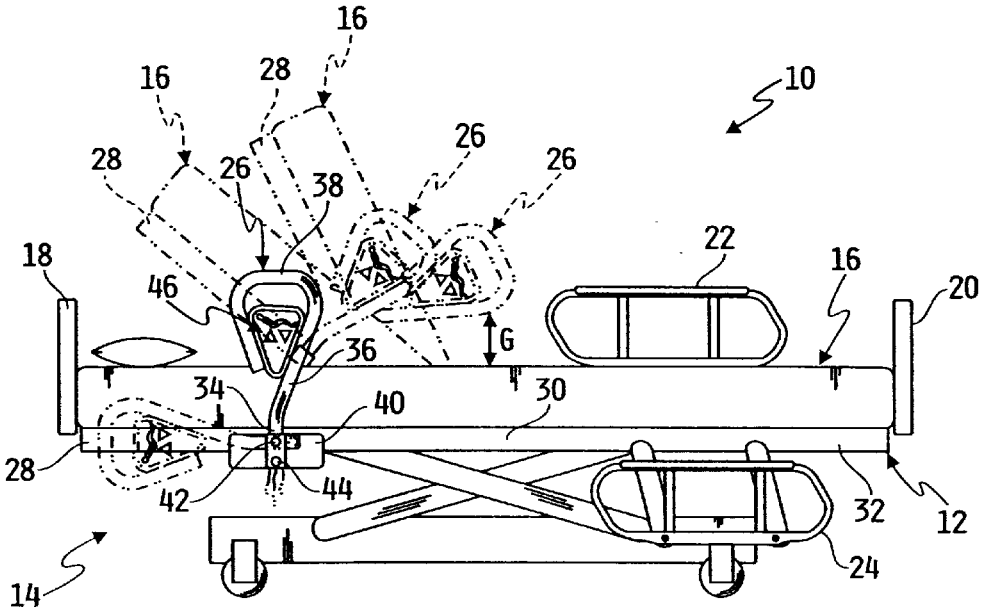
FIG. 1 is a side elevational view of one embodiment of a patient support according to the present invention.

Referring now to FIG. 1, a patient support apparatus, generally designated by the numeral 10, is shown. Patient support 10 in this embodiment is a hospital bed including a frame 12, a lower support structure 14 connected to frame 12, a patient support surface 16 supported by frame 12, a headboard 18, a footboard 20, a pair of side rails 22, 24 (side rail 24 is shown in the downward position), and an ambulatory assist arm apparatus 26. It should be understood that assist arm 26 of the present invention may readily be adapted for use with other types of patient support apparatuses, such as examination tables, etc., without departing from the concepts disclosed herein.

Frame 12 is generally rectangular in shape and includes a head portion 28, a seat portion 30, and a foot portion 32. Head portion 28, seat portion 30, and foot portion 32 are connected together by linkage (not shown), and articulate relative to one another into a variety of positions in a conventional manner. As will be further discussed below, head portion 28 of the frame 12 is shown in FIG. 1 in a horizontal position (solid lines), a partially articulated position (dotted lines), and a fully articulated position (dotted lines). As head portion 28 moves through its range of motion, it carries with it arm assist 26 and a portion of patient support surface 16. Side rails 22, 24 are of a conventional configuration and are both movable between an upward position (side rail 22) and a downward position (side rail 24). In the embodiment shown in FIG. 1, side rails 22, 24 are mounted to foot portion 32 of frame 12. As is well known in the art, side rails 22, 24 are movable between the upward and downward positions to retain a patient on patient support surface 16, and to permit ingress onto and egress from patient support surface 16, respectively.

Arm assist 26 is similar in certain regards to the ambulatory arm assist for a bed described in U.S. Pat. No. 6,240,583 ("the '583 patent"), the entire content of which is expressly incorporated herein by reference. In one embodiment of the invention, assist arm 26 is attached to head portion 28 of frame 12 as is described in the '583 patent. Assist arm 26 includes a first end 34 movably coupled to frame 12 and an arm 36 which extends therefrom and terminates at a grip 38 spaced apart from first end 34. Grip 38 of assist arm 26 provides a secure structure for the patient to hold during ingress onto and egress from support surface 16 of support 10. Since grip 38 is coupled to head portion 28 of frame 12, grip 38 moves with head portion 28 and a portion of support surface 16 during movement of head portion 28 relative to the other components of support 10 between the horizontal and articulated positions so that the patient will have a consistent and reliable support to grasp when entering or exiting support 10.

Assist arm 26 is mounted to support 10 by a bracket 40 using any of a variety of fastening methods. Assist arm 26 is rotatably mounted to bracket 40 at a pivot pin 42 such that assist arm 26 is movable between a use position (shown in solid lines in FIG. 1 and in dotted lines as part of the illustration depicting support 10 in the articulated positions) which is substantially perpendicular to head portion 28 of frame 12, and a storage position (shown in dotted lines in FIG. 1) which is substantially parallel to head portion 28 of frame 12. As assist arm 26 is moved between the use and storage positions, assist arm 26 pivots about pivot pin 42. Assist arm 26 further includes a locking or retaining mechanism 44 which may include a clamp, a spring loaded lock, a locking pin, or any suitable device for fixing assist arm 26 in a position relative to bracket 40 and allowing adjustment of the position of assist arm 26 relative to bracket 40 between the use and the storage positions when assist arm 26 is coupled to head portion 28 of frame 12. For example, retaining mechanism 44 may include a spring loaded locking detent which may be pulled laterally outwardly away from bracket 40 to permit movement of assist arm 26 between the use and storage positions. Such a detent, when retaining mechanism 44 is released, is biased toward bracket 40 and received by openings in bracket 40 to prevent movement of assist arm 26 from the desired position. In the embodiment shown in FIG. 1, two openings (not shown) are provided in bracket 40 (one to receive retaining mechanism 44 when assist arm 26 is in the use position, and one to receive retaining mechanism 44 when assist arm 26 is in the storage position).

As best shown in FIG. 1, when assist arm 26 is in the use position and head portion 28 is moved to a fully articulated position, a gap G remains between arm 26 and patient support surface 16. Gap G provides space for a patient to enter or exit bed 10. However, because assist arm 26 moves with head portion 28 of support 10, grip 38 is still provided when head portion 28 is in the fully articulated position to ease the patient's ingress onto or egress from patient support surface 16.

Assist arm 26 further includes a controller 46 which is formed to mount on arm 36 of assist arm 26 using fasteners (not shown) or any other conventional mounting technique. Controller 46 includes control buttons which are electrically connected to motors (not shown) used to raise and lower support surface 16 and articulate head portion 28, seat portion 30, and foot portion 32 of support 10 in a conventional manner. Controller 46 is mounted to assist arm 26 such that the control buttons are accessible by the patient or a caregiver when assist arm 26 is in the use position.

Figure 2:
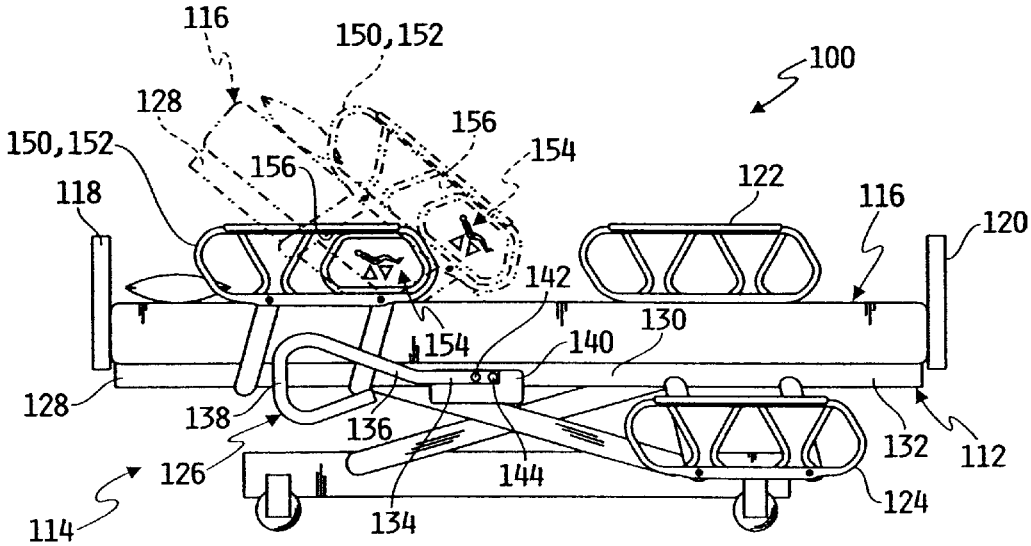
FIGS. 2 and 3 are side elevational views of another embodiment of a patient support according to the present invention.
Figure 3:
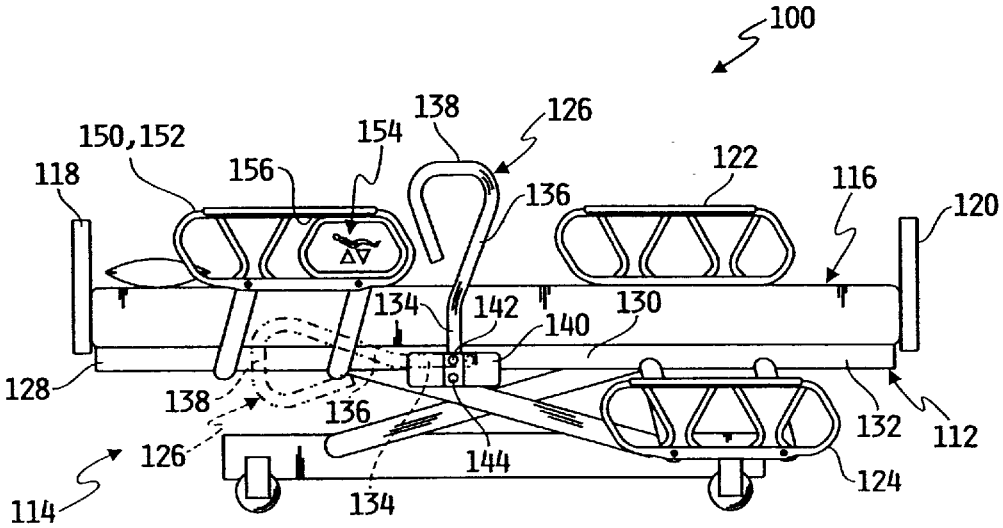

Referring now to FIG. 2, a support 100 is shown which is substantially the same as support 10 of FIG. 1. Accordingly, the reference designations for like components have been retained, but increased by 100. Unlike support 10, support 100 of FIG. 2 also includes side rails 150, 152 (only one shown) attached to head portion 128 of frame 112. Side rails 150, 152 are also adjustable between an upward position (as shown in FIG. 2) and a downward position. As shown in FIG. 2, side rails 150, 152 move with head portion 128 of frame 112 as head portion 128 is articulated between a horizontal position (solid lines) and an articulated position (dotted lines). Support 100 further includes an assist arm 126 mounted to seat portion 130 of frame 112 in a manner similar to that described above with reference to assist arm 26 of FIG. 1. As can be seen from the figure, at least one of side rails 150, 152 includes a controller 154 which is electrically connected to the motors (not shown) for operating support 100 as described above. Controller 154 is formed to mount within an opening 156 defined by side rails 150, 152. Like controller 46, controller 154 includes control buttons for positioning the various components of support 100 relative to one another. It should be noted from the figure that assist arm 126, while otherwise identical to assist arm 26, does not include a controller.

Figure 4:
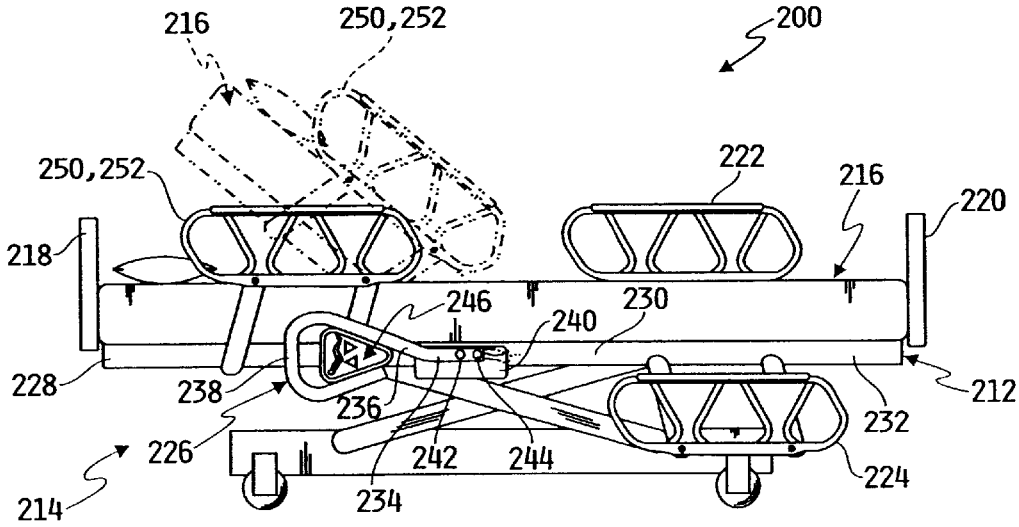
FIGS. 4 and 5 are side elevational views of yet another embodiment of a patient support according to the present invention.
Figure 5:
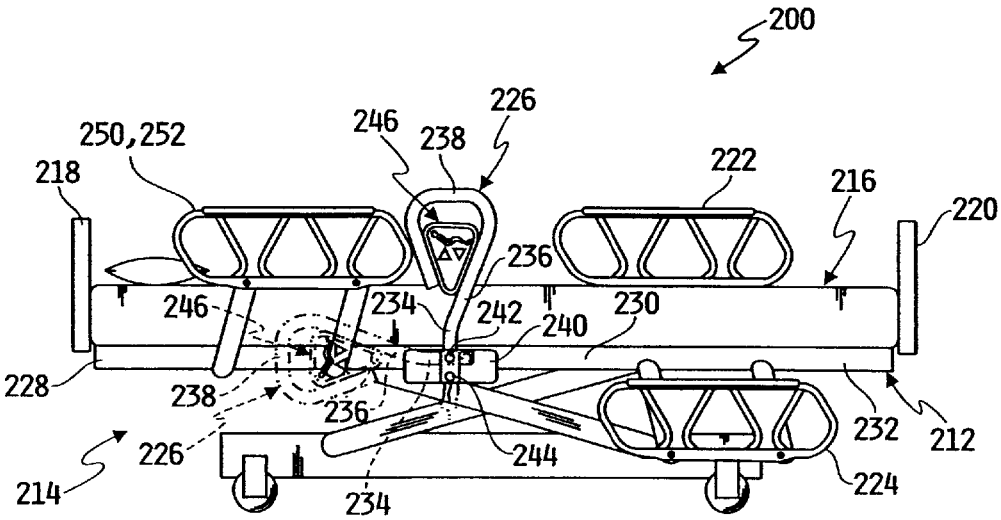

Referring now to FIGS. 4 and 5, another embodiment of the present invention is shown. Support 200 is substantially similar to support 100. Accordingly, the reference designations of like components have been retained, but increased by 100. Support 200 differs from support 100 in that assist arm 226 includes a controller 246 which is identical to controller 46 of FIG. 1. Side rails 250, 252 do not include a controller.

Figure 6:
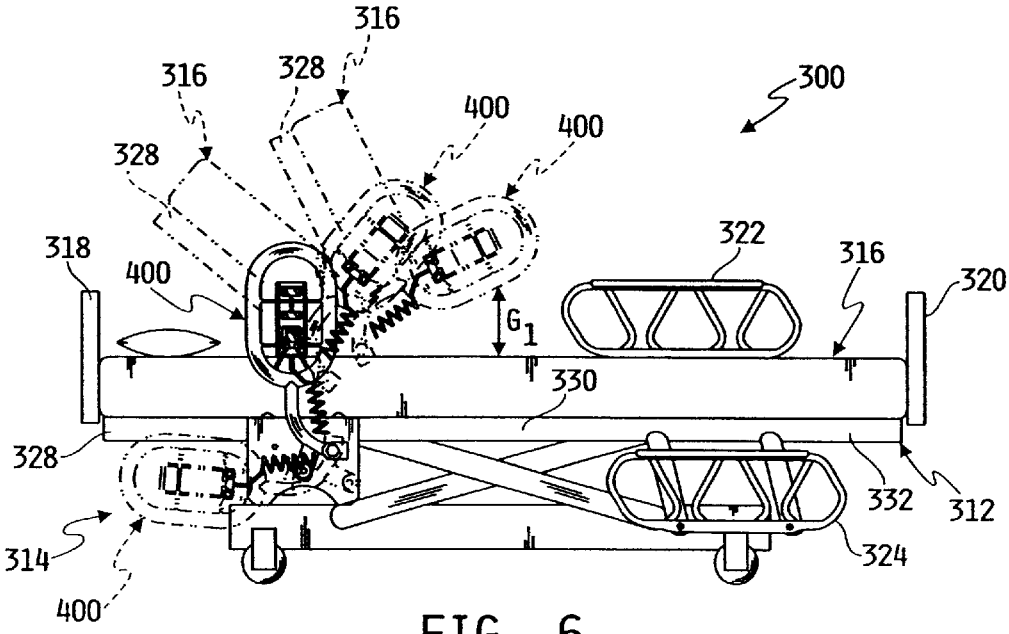
FIG. 6 is a side elevational view of a patient support including an assist arm according to another embodiment of the present invention.

FIGS. 6–11 show yet another embodiment of an assist arm according to the present invention. Support 300 is substantially similar to support 10 of FIG. 1. Accordingly, the reference designations of like components have been retained, but increased by 300. As should be apparent from the drawings, assist arm 26 of FIG. 1 is replaced by assist arm 400 of FIG. 6. The remainder of the components of support 300 described with reference to FIG. 1 are identical. As shown in FIG. 6, and as will be further described below, assist arm 400 is movable between a substantially horizontal, storage position (dotted lines) and a substantially vertical, use position (solid lines). As head portion 328 of frame 312 is articulated between a horizontal position (solid lines) and an articulated position (dotted lines), assist arm 400 moves with head portion 328 in the manner described above with reference to assist arm 26. Like assist arm 26, assist arm 400 provides a gap $G_1$ between assist arm 400 and patient support surface 316 when head portion 328 is in the fully articulated position.

Figure 7:
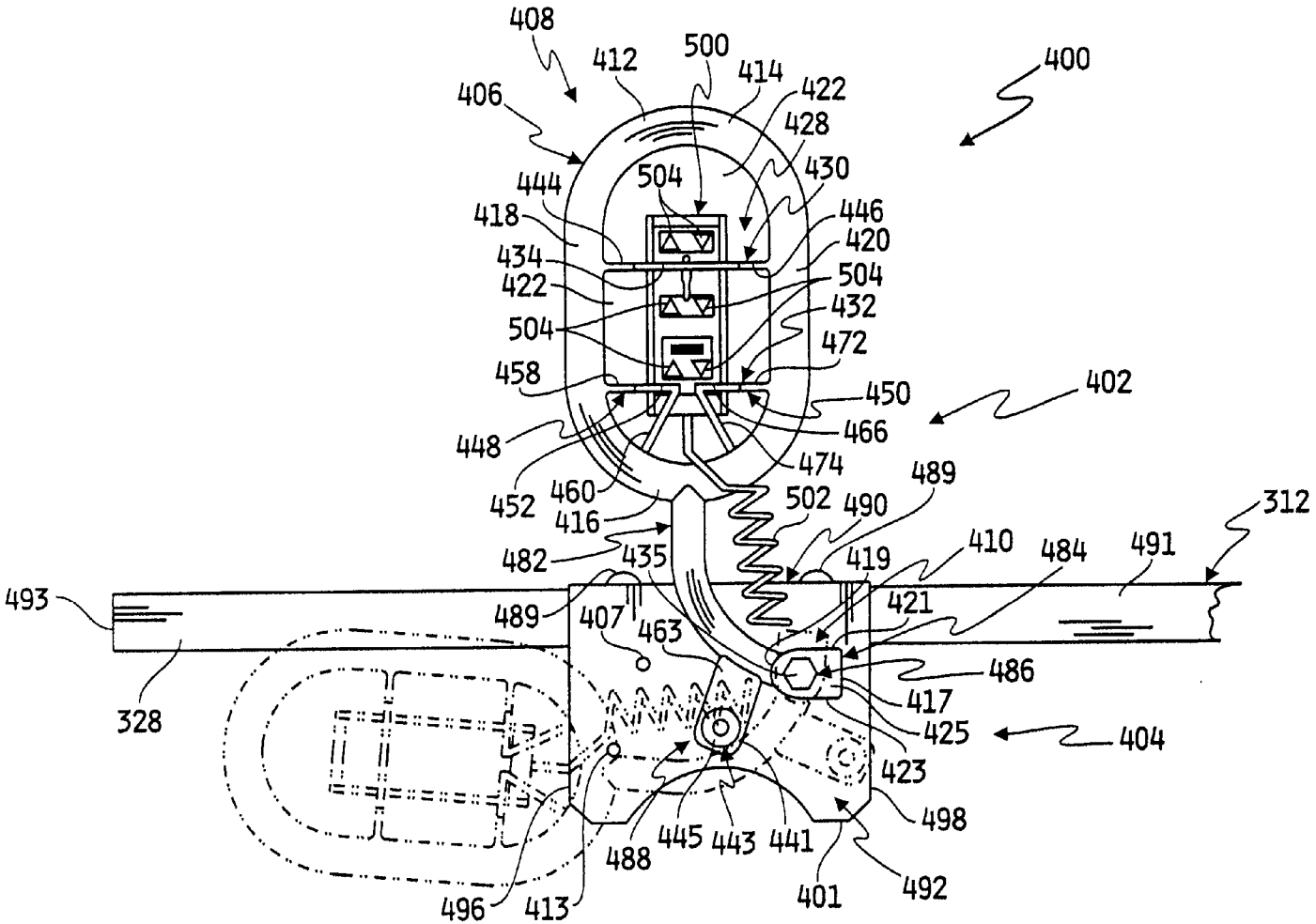
FIG. 7 is a partially fragmented, side elevational view of the assist arm shown in FIG. 6.
Figure 8:
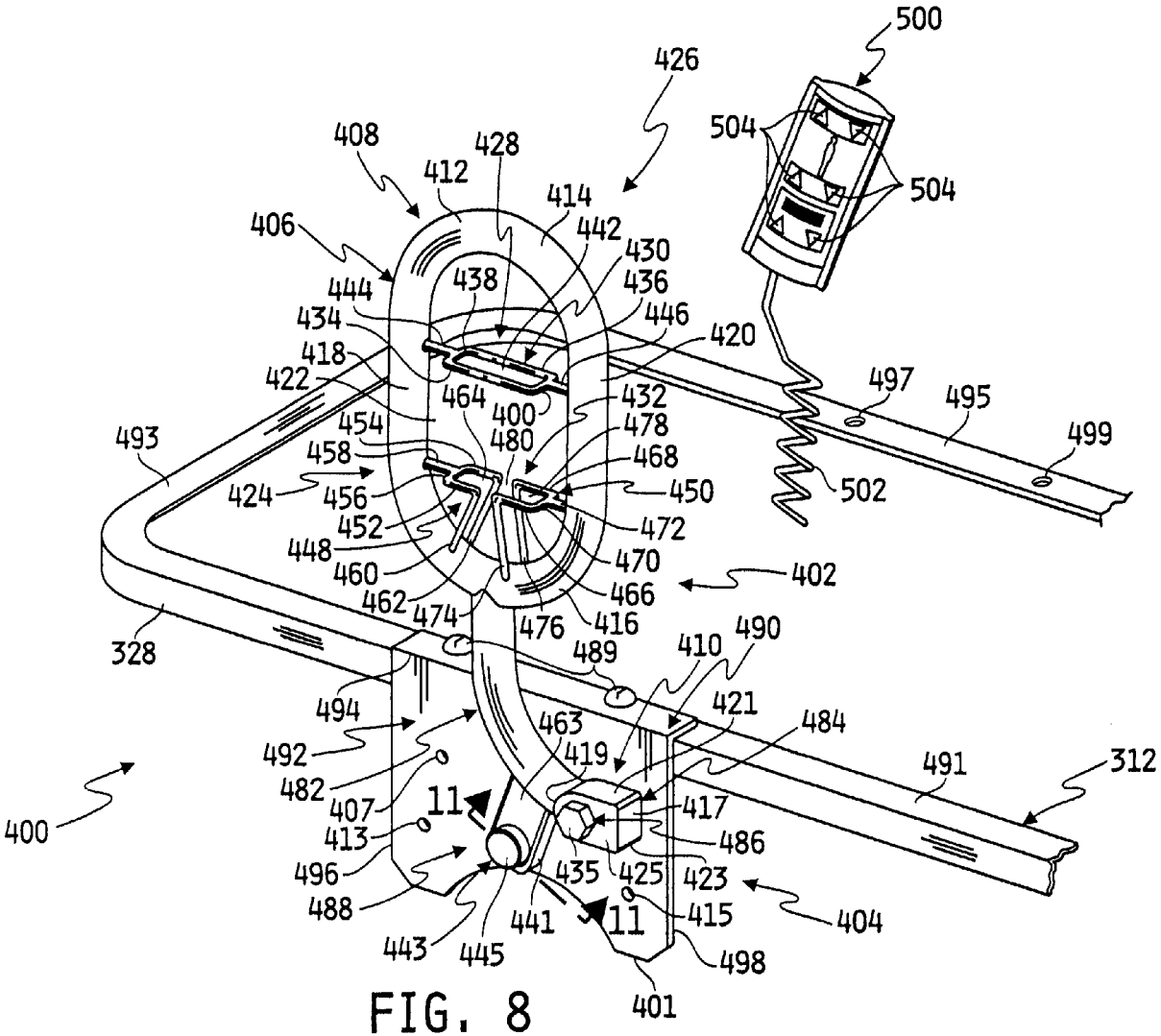
FIG. 8 is a partially fragmented, perspective view of the assist arm shown in FIGS. 6 and 7.

Referring now to FIGS. 7–10, assist arm 400 generally includes a body 402 and a mounting bracket 404. Body 402 includes a body frame 406 at a first end 408 and is pivotally connected to mounting bracket 404 at a second end 410. Body frame 406 includes an upper segment 412 which defines a grip 414, a lower segment 416 and a pair of substantially parallel side segments 418, 420. Upper segment 412 and lower segment 416 are curved and connect side segments 418, 420 such that body frame 406 forms an enlongated oval shape. Additionally, segments 412, 416, 418, and 420 of body frame 406 together define a central opening 422 which extends from a first side 424 of body 402 to a second side 426 of body 402 (FIG. 8).

A cradle 428 is mounted substantially within central opening 422 of body frame 406. Cradle 428 generally includes a first support 430 and a second support 432. First support 430 includes a pair of substantially parallel side segments 434, 436 which are connected together at their ends by end segments 438, 440 to form a substantially rectangular or oval opening 442. End segment 438 is attached to body frame side segment 418 by a connector segment 444. Similarly, end segment 440 is connected to body frame side segment 420 by a connector segment 446. As best shown in FIG. 7, first support side segments 434, 436, end segments 438, 440, and connector segments 444, 446 lie in substantially the same plane which is substantially perpendicular to a plane containing body frame side segments 418, 420.

Second support 432 of cradle 428 includes a pair of opposed brackets 448, 450. Bracket 448 includes a pair of substantially parallel side segments 452, 454, which are connected together at one end by an end segment 456. End segment 456 is connected to body frame side segment 418 by a connector segment 458. The other ends of side segments 452, 454 are connected to legs 460, 462 that are attached to lower segment 416 of body frame 406. Side segments 452, 454 and end segment 456 form an opening 464 for receiving a controller as described below. Bracket 450 of second support 432 similarly includes a pair of side segments 466, 468, an end segment 470, a connector segment 472, and a pair of legs 474, 476. Side segments 466, 468 and end segment 470 define an opening 478 which is substantially aligned with opening 464 of first bracket 448 for receiving a controller as described below. First bracket 448 and second bracket 450 together define a gap 480. As should be apparent from the drawings, opening 442 of first bracket 430 is substantially vertically aligned with openings 464, 478 of second support 432. Additionally, first support 430 and second support 432 are positioned substantially within central opening 422 defined by body frame 406.

Body 402 further includes an extension 482 connected between lower segment 416 of body frame 406 and a pivot block 484 at second end 410 of body 402. As will be further described below, body 402 pivots between a substantially vertical, use position and a substantially horizontal, storage position about a pivot member 486 which extends through pivot block 484. As best shown in FIG. 7, extension 482 curves between pivot block 484 and lower segment 416 of body frame 406 such that body frame 406 is offset both vertically and horizontally from pivot member 486. In one embodiment of the invention, a retainer 488 depends from extension 482 adjacent pivot block 484 as will be further described below.

Figure 9:
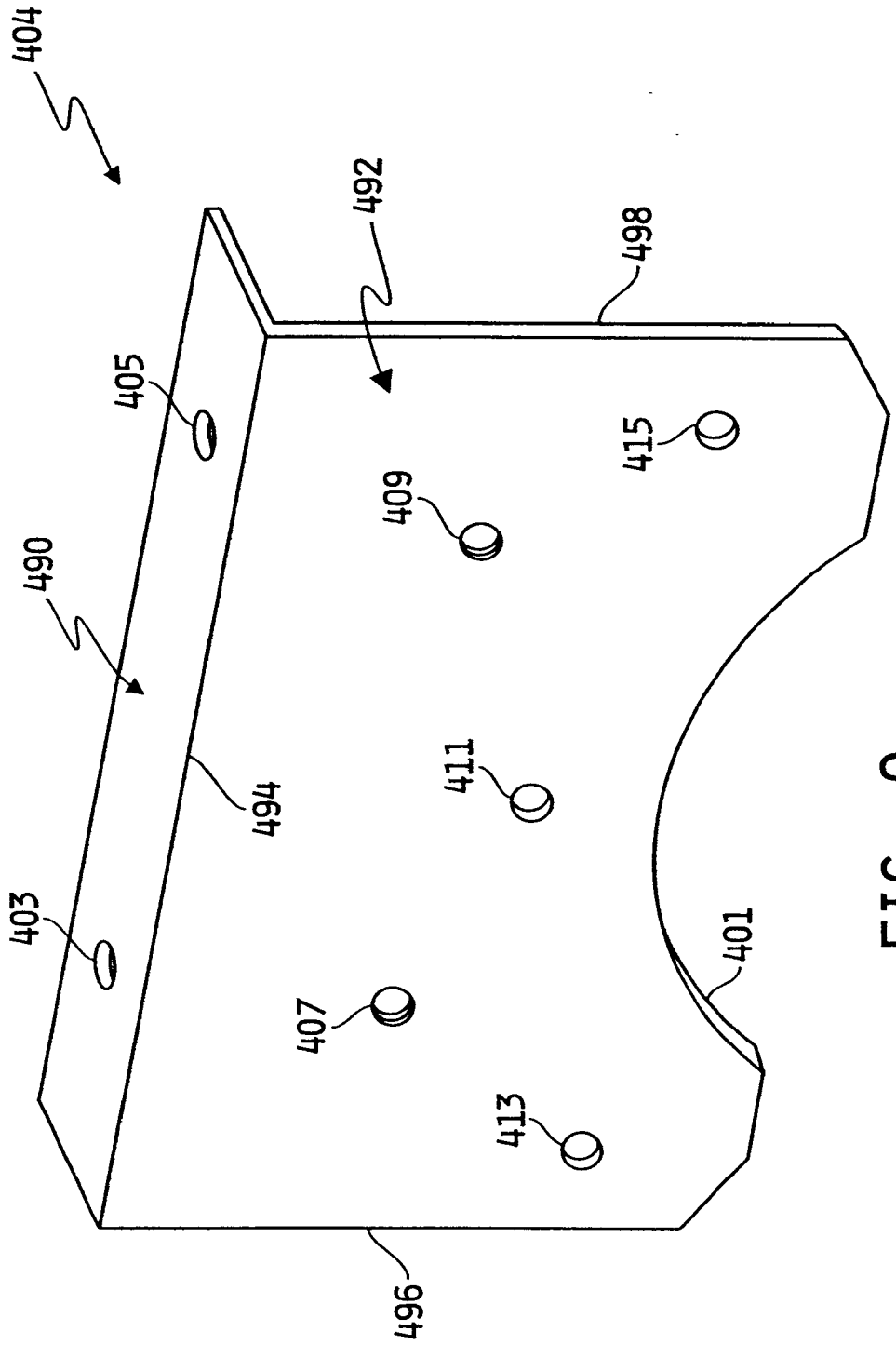
FIG. 9 is a perspective view of a mounting bracket of the assist arm shown in FIGS. 6–8.

Referring now to FIGS. 7–9, mounting bracket 404 of assist arm 400 generally includes a first plate 490 and a second plate 492. First plate 490 may be connected to second plate 492 such as by welding or other conventional attachment techniques. Alternatively, first plate 490 and second plate 492 may be formed from a single piece of material bent along an upper edge 494 such that first plate 490 is substantially perpendicular to second plate 492. Mounting bracket 404 also includes a first edge 496, a second edge 498, and a lower edge 401 that extends between first edge 496 and second edge 498. A pair of aligned openings 403, 405 (FIG. 9) extend through first plate 490. Openings 403, 405 are spaced apart to correspond with a standard spacing of threaded openings provided on portions of bed frame 312 as further described below. Second plate 492 includes a first pivot support 407, a second pivot support 409, a first stop 411, a second stop 413, and a third stop 415. Pivot supports 407, 409 are threaded openings formed through second plate 492 for receiving pivot member 486. Stops 411, 413, 415 are openings through second plate 492 for cooperating with retainer 488 to lock or hold assist arm body 402 in either the use or the storage position. It should be understood that pivot supports 407, 409 and stops 411, 413, 415 may be provided in a variety of different configurations. For example, pivot supports 407, 409 may be threaded lugs or nuts mounted to the outer surface of second plate 492. Also, stops 411, 413, 415 may be recesses or externally mounted stops. Additionally, more than three stops may be provided so that assist arm body 402 may be locked in a plurality of positions between the use and storage positions.

Figure 10:
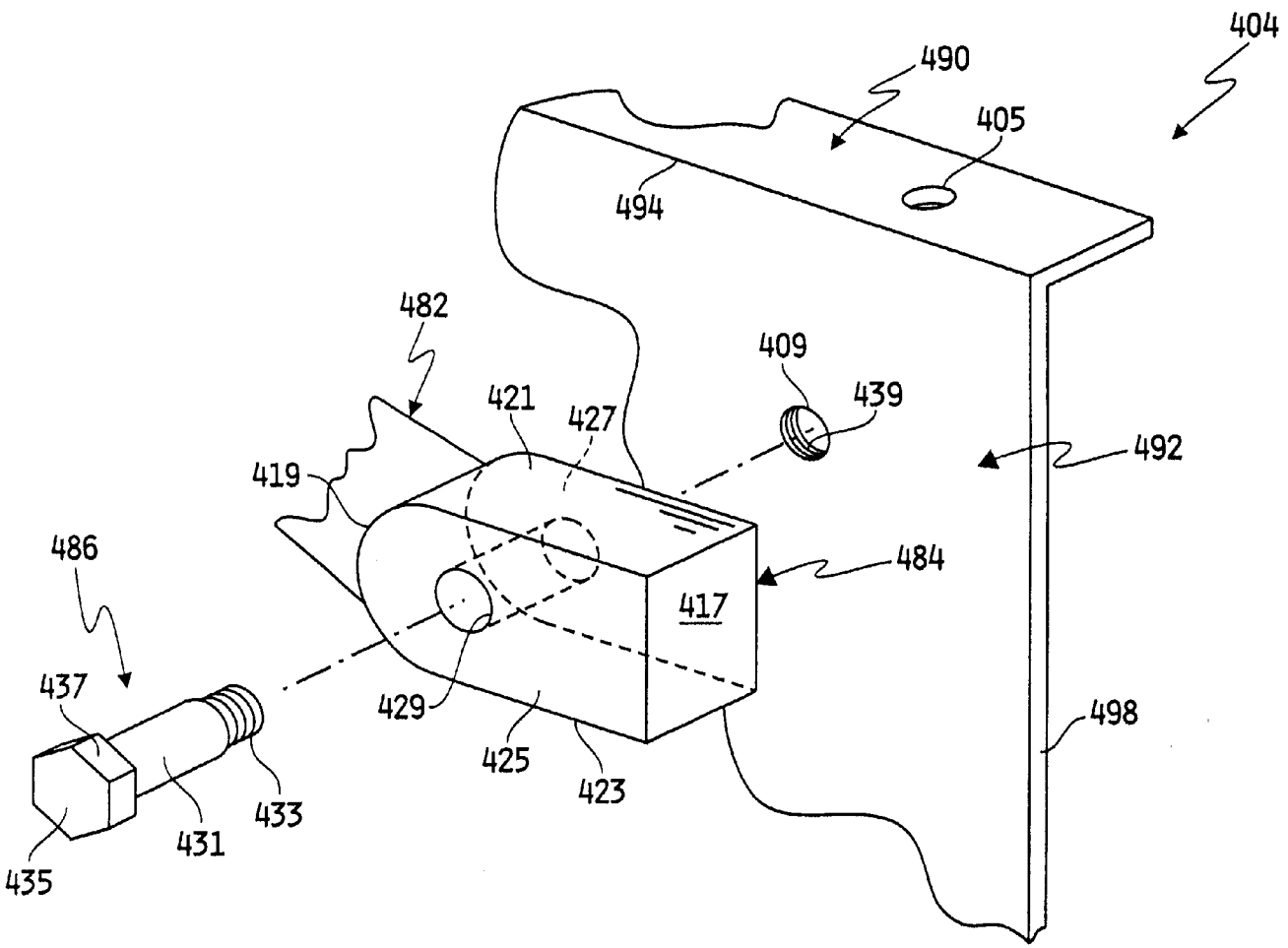
FIG. 10 is a partially fragmented, perspective view of a pivotal connection between the mounting bracket and the assist arm body of the assist arm embodiment shown in FIGS. 6–8.

Referring now to FIG. 10, pivot block 484 according to one embodiment of the present invention includes a flat end 417, a curved end 419 connected to extension 482, a top side 421, a bottom side 423, a first side 425, and a second side 427. An opening 429 extends through pivot block 484, perpendicularly between sides 425 and 427 to receive pivot member 486.

Pivot member 486 includes a cylindrical body 431 having a threaded end 433 and a head 435 opposite threaded end 433. The outer diameter of body 431 is slightly smaller than the diameter of opening 429 of pivot block 484 to permit rotation of pivot block 484 about pivot member 486. Head 435 includes flats 437 to permit the use of a wrench to tighten pivot member 486 into one of pivot supports 407, 409 as described below. Head 437 has a dimension which is larger than the diameter of opening 429 such that head 437 retains pivot block 484 (and therefore body 402) once pivot member 486 is attached to mounting bracket 404. Pivot supports 407, 409 (only one shown in FIG. 10) include threads 439 which are formed to mesh with threaded end 433 of pivot member 486. Upon assembly, pivot member 486 is inserted through opening 429 of pivot block 484 and threaded into, for example, second support 409. When pivot member 486 is fully threaded into second support 409, pivot block 484 is retained between second plate 492 of bracket 404 and head 435 of pivot member 486 for pivotal movement about cylindrical body 431 of pivot member 486.

As best shown in FIGS. 7 and 8, retainer 488 generally includes a retainer bracket 441 that extends from extension 482 and a spring-biased detent 443 that extends through bracket 441. It should be understood that spring-biased detent 443 may be any one of a variety of conventional types of detent mechanisms which include a knob 445 for pulling detent 443 outwardly away from mounting bracket 404 and an internal spring as described below for biasing the detent toward mounting bracket 404.

Figure 11:
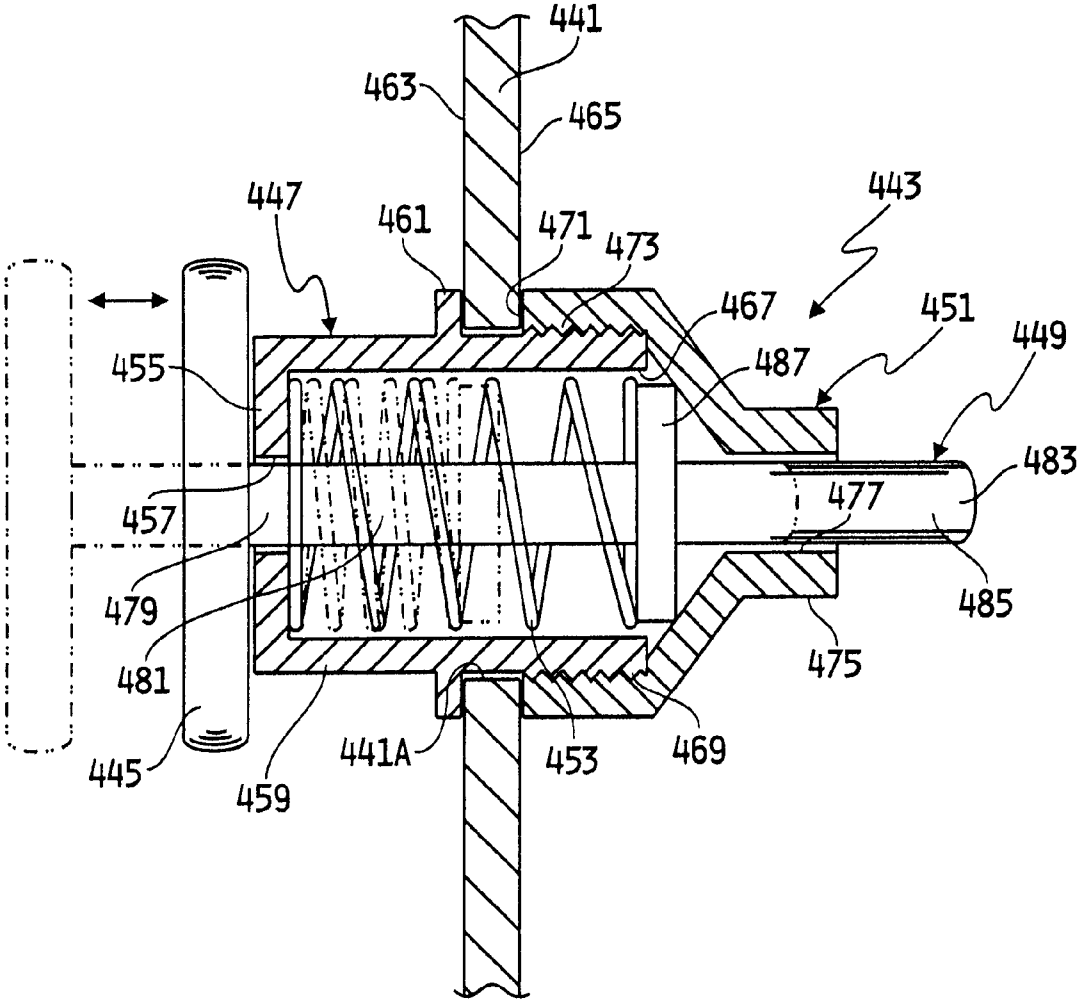
FIG. 11 is a partially fragmented, sectional view of a retainer component of the assist arm shown in FIGS. 6–8.

One possible detent 443 is shown in FIG. 11. Detent 443 includes a substantially cylindrical housing 447, a plunger assembly 449, a cap 451, and a spring 453. Housing 447 includes an end wall 455 having an opening 457 and a cylindrical side wall 459 around which is formed an annular shoulder 461 for abutting against either a first surface 463 or a second surface 465 of retainer bracket 441. Housing 447 further includes an open end 467 about which are formed exterior threads 469. Cap 451 includes an open end 471 with internal threads 473 that mesh with threads 469 of housing 447. Cap 451 tapers to a support end 475 which has a central opening 477 for supporting and guiding plunger assembly 449. Plunger assembly 449 includes knob 445 which is removably attached to a first end 479 of a shaft 481. A tip 483 is formed at the second end 485 of shaft 481. Finally, a stop 487 is attached to shaft 481 at a location between first end 479 and second 485.

Spring-biased detent 443 may be installed on retainer bracket 441 by inserting housing 447 through an opening 441A in retainer bracket 441 such that threads 469 pass through opening 441A and annular shoulder 461 engages, for example, first side 463 of retainer bracket 441. Spring 453 is then inserted through open end 467 of housing 447, and shaft 481 of plunger assembly 449 is inserted through the central opening formed by spring 453 until stop 487 rests against one end of spring 453. Shaft 481 is further inserted into housing 447 until end 479 extends through opening 457 of end wall 455. Knob 445 may then be attached to end 479 of shaft 481. Cap 451 is then be threaded onto housing 447 until retainer bracket 441 is compressed between annular shoulder 461 of housing 447 and open end 471 of cap 451. When cap 451 is being threaded onto housing 447, stop 487 of plunger assembly 449 compresses spring 453 against end wall 455 of housing 447.

As shown in solid lines in FIG. 11, when spring-biased detent 443 is attached to retainer bracket 441 in this manner, tip 483 of plunger assembly 449 extends beyond cap 451 and is biased outwardly by spring 453 away from second side 465 of retainer bracket 441. As will be further described below, assist arm 400 may be positioned such that tip 483 extends into one of stops 411, 413, 415 formed on mounting bracket 404 to lock arm 400 in a desired position. Tip 483 may be retracted from the stop by pulling knob 445 outwardly away from first side 463 of retainer bracket 441. As tip 483 is retracted, stop 487 further compresses spring 453 so that when knob 445 is released, spring 453 drives stop 487 (and tip 483) outwardly away from second side 465 of retainer bracket 441. It should be understood that spring-biased detent 443 may be mounted onto retainer bracket 441 in an opposite direction such that annular shoulder 461 engages second side 465 of retainer bracket 441 and tip 483 is biased by spring 453 outwardly away from first side 463 of retainer bracket 441.

As best shown in FIG. 8, a pair of fasteners 489 are used to attach mounting bracket 404 to frame 312. Specifically, fasteners 489, which may be standard Allen head or hex head bolts, are passed through openings 403, 405 (FIG. 9) of mounting bracket first plate 490 into correspondingly spaced, standard openings (not shown) provided on a first side 491 of frame 312. As should be apparent from the foregoing, when assist arm 400 is in the use position shown in FIGS. 7 and 8, tip 483 of spring-biased detent 443 extends into stop 411 (FIG. 9) of mounting bracket 404 to hold or lock arm 400 in the use position. Arm 400 may be pivoted downwardly toward a first end 493 of frame 312 by pulling handle 445 of spring-biased detent 443 outwardly away from first side 463 of retainer bracket 441 such that tip 483 is retracted from stop 411. Once tip 483 is retracted from stop 411, body 402 of assist arm 400 is free to rotate about pivot member 486 into the downward, storage position shown in dotted lines in FIG. 7. When body 402 reaches the storage position, spring-biased detent 443 may be released so that tip 483 is biased by spring 453 outwardly away from second side 465 of retainer bracket 441 and into stop 415 formed on mounting bracket 404.

One feature of assist arm 400 according to the present invention is that it is reversible. Specifically, mounting bracket 404 may be mounted to either first side 491 of frame 312 or a second side 495 of frame 312, with body 402 mounted to mounting bracket 404 (when in either position) such that body 402 pivots downwardly into the storage position toward end 493 of frame 312. Assist arm 400 may be moved from the first position shown in FIGS. 7 and 8 to a second position wherein mounting bracket 404 is mounted to second side 495 of frame 312 by removing fasteners 489 from first side 491 of frame 312 through first plate 490 of mounting bracket 404. Mounting bracket 404 may then be rotated 180° such that second edge 498 of mounting bracket 404 is adjacent end 493 of frame 312. Mounting bracket 404 may then be placed onto second side 495 of frame 312 such that openings 403, 405 of first plate 490 align with openings 499, 497 of second side 495. Fasteners 489 may then be inserted through first plate 490 of mounting bracket 404 into openings 497, 499 of second side 495 to secure mounting bracket 404 to second side 495.

Body 402 is repositioned to pivot downwardly toward end 493 of frame 312 by removing pivot member 486 from pivot support 409 of mounting bracket 404. Specifically, head 435 of pivot member 486 is rotated to unscrew threaded end 433 of pivot member 486 from threads 439 of pivot support 409. Pivot member 486 is then removed from opening 429 formed in pivot block 484. At this point, body 402 is completely detached from mounting bracket 404 since spring-biased detent 443 may simply be withdrawn from stop 411 formed in mounting bracket 404. Spring-biased detent 443 is then disassembled and reversed in the manner described above such that shoulder 461 engages second side 465 of retainer bracket 441 and tip 483 is biased outwardly away from first side 463. Next, spring-biased detent 443 may again be placed into stop 411. When in this position, opening 429 of pivot block 484 may be aligned with pivot support 407 of mounting bracket 404. Once these openings are aligned, pivot member 486 is inserted through opening 429 of pivot block 484 so that threaded end 433 may be threaded into pivot support 407, thereby capturing pivot block 484 between second plate 492 of mounting bracket 404 and head 435 of pivot member 486. It should be understood that when in this position, side 425 of pivot block 484 is adjacent second plate 492 of mounting bracket 404 and side 427 of pivot block 486 is adjacent head 435 of pivot member 486. Consequently, when tip 483 of spring-biased detent 443 is withdrawn from stop 411 in the manner described above, body 402 of assist arm 400 may be moved downwardly toward end 493 of frame 312 until tip 483 registers with stop 413 of mounting bracket 404. When in this position, knob 445 of spring-biased detent 443 is released so that spring 453 may bias tip 483 of spring-biased detent 443 into stop 413, thereby locking assist arm 400 in the storage position.

As shown in FIGS. 7 and 8, cradle 428 of arm body 402 receives and retains a controller 500. Controller 500 is connected through cord 502 to the motors and other apparatus (not shown) which adjust the position of bed 300. Controller 500 includes a plurality of buttons 504 for adjusting the height of bed 300, and the position of head portion 328 and foot portion 332 relative to seat portion 330. Controller 500 may be placed into cradle 428 in an outward position such that buttons 504 face outwardly toward side 424 of body 402 by inserting controller 500 upwardly through opening 442 formed by first support 430 until the lower end of controller 500 clears second support 432. Controller 500 is then lowered into openings 464, 478 formed by brackets 448, 450, respectively. It should be noted that cord 502 fits between brackets 448, 450 through gap 480. The lower end of controller 500 may then rest against lower segment 416 of body frame 406, supported in a generally vertical position by first and second supports 430, 432. When positioned in the above described outward position, a caregiver may adjust the orientation of bed 300 by actuating buttons 504 which face outwardly away from bed 300.

It should be noted that a patient on support surface 316 may also operate controller 500 by placing the controller in an inward position. Specifically, controller 500 may be lifted upwardly so that the lower end of controller 500 clears second support 432. Controller 500 may then be withdrawn from opening 442 of first support 430, rotated 180°, and reinserted into opening 442. Controller 500 is then lowered into openings 464, 478 of second support 432 with cord 502 passing through gap 480. The lower end of controller 500 may then rest against lower segment 416 of body frame 406. It should be understood, however, that when controller 500 is in the inward position, and body 402 of assist arm 400 is moved to the storage position, buttons 504 of controller 500 will be essentially inaccessible by either the patient or the caregiver.

The foregoing description of the invention is illustrative only, and is not intended to limit the scope of the invention to the precise terms set forth. Although the invention has been described in detail with reference to certain illustrative embodiments, variations and modifications exist within the scope and spirit of the invention as described and defined in the following claims.

What is claimed is:

1. An assist arm for use with a patient support having a support surface and a frame including a first side, a second side opposite the first side, a first end, and a second end opposite the first end, the assist arm including:

a mounting bracket adapted for attachment to the first side of the frame when in a first position, and to the second side when in a second position; and a body having a first end defining a grip and a second end removably connected to the mounting bracket for movement relative to the mounting bracket, the body having a first side and a second side opposite the first side, the body being movable between a use position wherein the grip is positioned above the support surface when the mounting bracket is in the first position and when the mounting bracket is in the second position, and a storage position wherein the grip is adjacent the first end of the frame when the mounting bracket is in the first position and when the mounting bracket is in the second position, the body being reversible between a first body position and a second body position, the first side of the body facing the mounting bracket when in the first body position and the second side of the body facing the mounting bracket when in the second body position.

2. The assist arm of claim 1 wherein the mounting bracket includes fasteners for removably attaching the mounting bracket to the frame.

3. The assist arm of claim 2 wherein the mounting bracket includes a first plate and a second plate, the first plate including openings, the fasteners extending through the openings into the first side of the frame when the mounting bracket is in the first position, and through the openings into the second side of the frame when the mounting bracket is in the second position.

4. The assist arm of claim 3 wherein the first plate is substantially perpendicular to the second plate.

5. The assist arm of claim 1 wherein the body includes a frame at the first end and an extension between the body frame and the second end.

6. The assist arm of claim 5 wherein the body frame includes an upper segment, a lower segment, and a pair of side segments, together defining a central opening.

7. The assist arm of claim 6 wherein the upper segment defines the grip and the lower segment is connected to the extension.

8. The assist arm of claim 5 wherein the body includes a retainer for retaining the body in the use position and the storage position.

9. The assist arm of claim 8 wherein the mounting bracket includes a first edge, a second edge, a first stop for cooperating with the retainer to retain the body in the use position when the mounting bracket is in the first position, a second stop for cooperating with the retainer to retain the body in the use position when the mounting bracket is in the second position, a third stop for cooperating with the retainer to retain the body in the storage position when the mounting bracket is in the first position, and a fourth stop for cooperating with the retainer to retain the body in the storage position when the mounting bracket is in the second position.

10. The assist arm of claim 8 wherein the first stop and the second stop are provided by a single opening, centrally located between the first edge and the second edge.

11. The assist arm of claim 8 wherein the third stop is located adjacent the second edge and the fourth stop is located adjacent the first edge.

12. The assist arm of claim 9 wherein the retainer includes a detent having an end, the stops including openings in the mounting bracket for receiving the detent end.

13. The assist arm of claim 1 wherein the body includes a first side that faces away from the mounting bracket when the body is connected to the mounting bracket and the mounting bracket is in the first position, and a second side that faces away from the mounting bracket when the body is connected to the mounting bracket and the mounting bracket is in the second position.

14. An assist arm for use with a patient support having a support surface and a frame including a first side, a second side opposite the first side, a first end, and a second end opposite the first end, the assist arm including:

a mounting bracket adapted for attachment to the first side of the frame when in a first position, and to the second side when in a second position; and a body having a first end defining a grip and a second end removably connected to the mounting bracket for movement relative to the mounting bracket, the body being movable between a use position wherein the grip is positioned above the support surface when the mounting bracket is in the first position and when the mounting bracket is in the second position, and a storage position wherein the grip is adjacent the first end of the frame when the mounting bracket is in the first position and when the mounting bracket is in the second position, the mounting bracket including a first edge, a second edge, a first pivot support adjacent the first edge, and a second pivot support adjacent the second edge, the first and second pivot supports for movably supporting the second end of the body.

15. The assist arm of claim 14, wherein the body includes a pivot member extending through an opening in the second end of the body, the pivot member being received by the second pivot support when the mounting plate is in the first position and by the first pivot support when the mounting plate is in the second position.

16. The assist arm of claim 15, wherein the pivot member is a bolt having a threaded end, the first and second pivot supports each including a threaded opening for receiving the threaded end of the bolt.

17. The assist arm of claim 15 wherein the second end opening has a diameter that is larger than a diameter of the pivot member to permit pivotal movement of the body relative to the mounting bracket about the pivot member.

18. An assist arm for use with a patient support having a support surface and a frame including a first side, a second side opposite the first side, a first end, and a second end opposite the first end, the assist arm including:

a mounting bracket adapted for attachment to the first side of the frame when in a first position, and to the second side when in a second position; and a body having a first end defining a grip, a second end removably connected to the mounting bracket for movement relative to the mounting bracket, a frame at the first end, and an extension between the body frame and the second end, the body frame including an upper segment, a lower segment, and a pair of side segments, together defining an elongated oval with a central opening, the body being movable between a use position wherein the grip is positioned above the support surface when the mounting bracket is in the first position and when the mounting bracket is in the second position, and a storage position wherein the grip is adjacent the first end of the frame when the mounting bracket is in the first position and when the mounting bracket is in the second position.

19. An assist arm for use with a patient support having a support surface and a frame including a first side, a second side opposite the first side, a first end, and a second end opposite the first end, the assist arm including:

a mounting bracket adapted for attachment to the first side of the frame when in a first position, and to the second side when in a second position; and a body having a first end defining a grip, a second end removably connected to the mounting bracket for movement relative to the mounting bracket, a frame at the first end and an extension between the body frame and the second end, the extension curving between the second end and the body frame such that the body frame is offset vertically and horizontally from the second end, the body being movable between a use position wherein the grip is positioned above the support surface when the mounting bracket is in the first position and when the mounting bracket is in the second position, and a storage position wherein the grip is adjacent the first end of the frame when the mounting bracket is in the first position and when the mounting bracket is in the second position.

20. The assist arm of claim 19, wherein the body frame is offset vertically and horizontally from the second end when in the use position and when in the storage position.

21. An assist arm for use with a patient support having a support surface and a frame including a first side, a second side opposite the first side, a first end, and a second end opposite the first end, the assist arm including:

a mounting bracket adapted for attachment to the first side of the frame when in a first position, and to the second side when in a second position; and a body having a first end defining a grip, a second end removably connected to the mounting bracket for movement relative to the mounting bracket, a frame at the first end, an extension between the body frame and the second end, and a retainer depending from the extension for retaining the body in the use position and the storage position, the body being movable between a use position wherein the grip is positioned above the support surface when the mounting bracket is in the first position and when the mounting bracket is in the second position, and a storage position wherein the grip is adjacent the first end of the frame when the mounting bracket is in the first position and when the mounting bracket is in the second position.

22. The assist arm of claim 21 wherein the retainer includes a spring-biased detent for cooperating with the mounting bracket to retain the body in the use position and the storage position.

23. The assist arm of claim 22 wherein the retainer includes a retainer bracket depending from the extension.

24. The assist arm of claim 23 wherein the retainer bracket includes a first side that faces away from the mounting bracket when the body is connected to the mounting bracket in the first position, and a second side that faces away from the mounting bracket when the body is attached to the mounting bracket in the second position, the spring-biased detent being removably received by the retainer bracket so that the detent extends through the second end and is biased toward the mounting bracket when the body is connected to the mounting bracket when the mounting bracket is in the first position and when the mounting bracket is in the second position.

25. An assist arm for use with a patient support having a support surface and a frame, the assist arm including:

a controller including buttons for adjusting the position of the patient support;

a mounting bracket adapted for removable attachment to the frame; and a body connected to the mounting bracket for movement between a use position wherein the body extends above the support surface and a storage position wherein the body is positioned below the support surface, the body including an opening, a grip, and a cradle spanning the opening for supporting the controller such that the buttons are accessible for use.

26. The assist arm of claim 25 wherein the body includes a frame having an upper segment, a lower segment, and a pair of side segments that together define the opening.

27. The assist arm of claim 25 wherein the body includes a first side and a second side opposite the first side, the opening extending between the first side and the second side, the cradle being configured to support the controller substantially within the opening.

28. The assist arm of claim 27 wherein the controller may be inserted into and removed from the cradle from the first side of the body and from the second side of the body.

29. The assist arm of claim 28 wherein the controller may be positioned within the cradle in an outward position wherein the buttons are accessible from the first side of the body when the body is in the use position and when the body is in the storage position, and an inward position wherein the buttons are accessible from the second side of the body when the body is in the use position, but not accessible from the second side of the body when the body is in the storage position.

30. The assist arm of claim 25 wherein the cradle includes a first support disposed adjacent the grip and a second support spaced apart from the first support.

31. The assist arm of claim 30 wherein the body includes a pair of substantially parallel side segments, the first support extending across the opening in substantially perpendicular relationship to the side segments.

32. The assist arm of claim 31 wherein the first support defines an opening for receiving the controller.

33. The assist arm of claim 31 wherein the first support includes a pair of substantially parallel side segments connected together at one end by a first end segment and at another end by a second end segment, a first connector segment extending between the first end segment and one of the body side segments, and a second connector segment extending between the second end segment and the other of the body side segments.

34. The assist arm of claim 33 wherein the first support side segments, end segments, and connector segments lie in substantially the same plane.

35. The assist arm of claim 33 wherein the first support side segments and end segments define an opening for receiving the controller.

36. The assist arm of claim 30 wherein the controller includes a cord, the second support including a pair of opposed brackets that extend toward one another into the opening and define a gap through which the cord passes as the controller is inserted into and removed from the cradle.

37. The assist arm of claim 36 wherein each of the opposed brackets forms an opening for receiving the controller.

38. An assist arm for use with a patient support having a support surface and a frame, the assist arm including:

a mounting bracket adapted for attachment to the frame;

a body including a first end defining a grip, a cradle connected to the first end, and a second end movably connected to the mounting bracket, the body being movable between a use position wherein the grip is positioned above a portion of the support surface and a storage position wherein the grip is positioned substantially below the portion of the support surface, the body being configured to bear a substantial portion of the weight of the patient when in the use position; and a controller including buttons for adjusting the position of the patient support, the controller being removably supported by the cradle so that the buttons are accessible for use.

39. The assist arm of claim 38 wherein the mounting bracket includes a pivot support for movably supporting the second end of the body.

40. The assist arm of claim 38 wherein the body includes a frame at the first end and an extension between the body frame and the second end.

41. The assist arm of claim 38, wherein the grip includes a substantially horizontal surface configured to bear patient weight and an opening located beneath the substantially horizontal surface.

42. The assist arm of claim 38, further including a retainer such that the body is selectively retained in at least one of the use position and the storage position.

43. An assist arm for use with a patient support having a support surface and a frame, the assist arm including:

a mounting bracket adapted for attachment to the frame;

a body including a first end defining a grip, a cradle connected to the first end, and a second end movably connected to the mounting bracket, the body being movable between a use position wherein the grip is positioned above a portion of the support surface and a storage position wherein the grip is positioned substantially below the portion of the support surface; and a controller including buttons for adjusting the position of the patient support, the controller being removably supported by the cradle so that the buttons are accessible for use, the mounting bracket including a pivot support for movably supporting the second end of the body, and the body including a pivot member extending through an opening in the second end of the body, the pivot member being received by the pivot support.

44. The assist arm of claim 43 wherein the pivot member is a bolt having a threaded end, the pivot support including a threaded opening for receiving the threaded end of the bolt.

45. The assist arm of claim 43 wherein the second end opening has a diameter that is larger than a diameter of the pivot member to permit pivotal movement of the body relative to the mounting bracket about the pivot member.

46. An assist arm for use with a patient support having a support surface and a frame, the assist arm including:

a mounting bracket adapted for attachment to the frame;

a body including a first end defining a grip, a cradle connected to the first end, and a second end movably connected to the mounting bracket, the body being movable between a use position wherein the grip is positioned above a portion of the support surface and a storage position wherein the grip is positioned substantially below the portion of the support surface, the body further including a frame at the first end and an extension between the body frame and the second end; and a controller including buttons for adjusting the position of the patient support, the controller being removably supported by the cradle so that the buttons are accessible for use, the body frame including an upper segment, a lower segment, and a pair of side segments, together defining a central opening.

47. The assist arm of claim 46 wherein the upper segment defines the grip and the lower segment is connected to the extension.

48. The assist arm of claim 46 wherein the segments form an elongated oval.

49. The assist arm of claim 46 wherein the body includes a first side and a second side opposite the first side, the central opening extending between the first side and the second side, the cradle being configured to support the controller substantially within the opening.

50. The assist arm of claim 49 wherein the controller may be inserted into and removed from the cradle from the first side of the body and from the second side of the body.

51. The assist arm of claim 50 wherein the controller may be positioned within the cradle in an outward position wherein the buttons are accessible from the first side of the body when the body is in the use position and when the body is in the storage position, and an inward position wherein the buttons are accessible from the second side of the body when the body is in the use position, but not accessible from the second side of the body when the body is in the storage position.

52. The assist arm of claim 51 wherein the controller includes a cord, the second support including a pair of opposed brackets that extend toward one another into the central opening and define a gap through which the cord passes as the controller is inserted into and removed from the cradle.

53. The assist arm of claim 52 wherein each of the opposed brackets forms an opening for receiving the controller.

54. The assist arm of claim 46 wherein the cradle includes a first support disposed adjacent the grip and a second support spaced apart from the first support, the body including a pair of substantially parallel side segments, the first support extending across the central opening in substantially perpendicular relationship to the side segments.

55. The assist arm of claim 54 wherein the first support defines an opening for receiving the controller.

56. The assist arm of claim wherein the first support includes a pair of substantially parallel side segments connected together at one end by a first end segment and at another end by a second end segment, a first connector segment extending between the first end segment and one of the body side segments, and a second connector segment extending between the second end segment and the other of the body side segments.

57. The assist arm of claim 56 wherein the first support side segments, end segments, and connector segments lie in substantially the same plane.

58. The assist arm of claim 56 wherein the first support side segments and end segments define an opening for receiving the controller.

59. An assist arm for use with a patient support having a support surface and a frame, the assist arm including:

a mounting bracket adapted for attachment to the frame;

a body including a first end defining a grip, a cradle connected to the first end, and a second end movably connected to the mounting bracket, the body being movable between a use position wherein the grip is positioned above a portion of the support surface and a storage position wherein the grip is positioned substantially below the portion of the support surface, the body further including a frame at the first end and an extension between the body frame and the second end, the extension curving between the second end and the body frame such that the body frame is offset vertically and horizontally from the second end; and a controller including buttons for adjusting the position of the patient support, the controller being removably supported by the cradle so that the buttons are accessible for use.

60. An assist arm for use with a patient support having a support surface and a frame, the assist arm including:

a mounting bracket adapted for attachment to the frame;

a hod including a first end defining a grip, a cradle connected to the first end, a second end movably connected to the mounting bracket, a frame at the first end, an extension between the body frame and the second end, and a retainer, the body being movable between a use position wherein the grip is positioned above a portion of the support surface and a storage position wherein the grip is positioned substantially below the portion of the support surface, the retainer retaining the body in the use position and the storage position; and a controller including buttons for adjusting the position of the patient support, the controller being removably supported by the cradle so that the buttons are accessible for use.

61. The assist arm of claim 60 wherein the retainer depends from the extension.

62. The assist arm of claim 61 wherein the retainer includes a spring-biased detent for cooperating with the mounting bracket to retain the body in the use position and the storage position.

63. The assist arm of claim 62 wherein the retainer includes a retainer bracket depending from the extension.

64. The assist arm of claim 60 wherein the mounting bracket includes a first stop for cooperating with the retainer to retain the body in the use position and a second stop for cooperating with the retainer to retain the body in the storage position.

65. The assist arm of claim 64 wherein the first stop is an opening, centrally located on the mounting bracket.

66. The assist arm of claim 64 wherein the second stop is located adjacent an edge of the mounting bracket.

67. The assist arm of claim 64 wherein the retainer includes a detent having an end, the stops including openings in the mounting bracket for receiving the detent end.

68. An assist arm for use with a patient support having a support surface and a frame including a first side, a second side, a first end, and a second end, the assist arm including:

means for controlling the position of the patient support;

means for mounting the assist arm to the first side of the frame when the assist arm is in a first position, and to the second side of the frame when the assist arm is in a second position; and means for providing a grip to assist a patient, the providing means including means for removably connecting the providing means to the mounting means so that the providing means pivots between a use position wherein the grip is positioned above a portion of the support surface, and a storage position wherein the grip is positioned substantially below the portion of the support surface, means for retaining the providing means in the use position and in the storage position, means for extending the providing means from the connecting means so that the providing means is vertically and horizontally offset from the connecting means, and means for cradling the controller means.

69. A hospital bed, including:

a frame for supporting a patient support surface, the frame including a head portion, a seat portion, and a foot portion;

a side rail connected to the foot portion;

an assist arm connected to the head portion, the assist arm being movable between a use position wherein the assist arm extends above the patient support surface and a storage position wherein the assist arm is positioned below the patient support surface, the assist arm being configured to bear a substantial portion of the weight of the patient when in the use position; and a controller mounted to the assist arm.

70. The bed of claim 69 wherein the assist arm is substantially perpendicular to the head portion when in the use position.

71. The bed of claim 69 wherein the assist arm is substantially parallel to the head portion when in the storage position.

72. The assist arm of claim 69, wherein the assist arm includes a grip that includes a substantially horizontal surface configured to bear patient weight and an opening located beneath the substantially horizontal surface.

73. The assist arm of claim 72, wherein the controller is a bed controller.

74. The assist arm of claim 73, wherein the bed controller includes means for causing articulation of the bed and an opening located beneath the substantially horizontal surface.

75. The assist arm of claim 69, wherein the frame is an articulating frame.

76. A hospital bed, including:

a frame for supporting a patient support surface, the frame including a head portion, a seat portion, and a foot portion;

a first side rail connected to the foot portion;

a second side rail connected to the head portion;

a controller mounted to the second side rail; and an assist arm connected to the seat portion, the assist arm being movable between a use position wherein the assist arm extends above the patient support surface and a storage position wherein the assist arm is positioned below the patient support surface.

77. The bed of claim 76 wherein the assist arm is substantially perpendicular to the seat portion when in the use position.

78. The bed of claim 76 wherein the assist arm is substantially parallel to the seat portion when in the storage position.

79. The hospital bed of claim 76, wherein the first siderail, second siderail, and assist arm are all located on one side of the bed.

80. A hospital bed, including:

a frame for supporting a patient support surface, the frame including a head portion, a seat portion, and a foot portion;

a first side rail connected to the foot portion;

a second side rail connected to the head portion;

an assist arm connected to the seat portion, the assist arm being movable between a use position wherein the assist arm extends above the patient support surface and a storage position wherein the assist arm is positioned below the patient support surface, the assist arm being configured to bear a substantial portion of the weight of the patient when in the use position; and a controller mounted to the assist arm.

81. The bed of claim 80 wherein the assist arm is substantially perpendicular to the seat portion when in the use position.

82. The bed of claim 80 wherein the assist arm is substantially parallel to the seat portion when in the storage position.

83. The assist arm of claim 80, wherein the assist arm includes a grip that includes a substantially horizontal surface configured to bear patient weight.

84. The assist arm of claim 80, wherein the assist arm includes a grip that includes a substantially horizontal surface configured to bear patient weight.

* * * * *